US011311054B2

(12) United States Patent
Yan et al.

(10) Patent No.: US 11,311,054 B2
(45) Date of Patent: Apr. 26, 2022

(54) METHOD FOR FILLING AEROSOL GENERATING PRODUCT AND PREPARED AEROSOL GENERATING PRODUCT

(71) Applicant: Yunnan Xike Science & Technology Co., Ltd, Kunming (CN)

(72) Inventors: Ningning Yan, Kunming (CN); Yong Zhang, Kunming (CN); Zhennan Huang, Kunming (CN); Yuefeng Chen, Kunming (CN); Shenghong Yuan, Kunming (CN); Qiang Zhang, Kunming (CN); Songfeng Wang, Kunming (CN); Zheng Chen, Kunming (CN)

(73) Assignee: YUNNAN XIKE SCIENCE & TECHNOLOGY CO., LTD, Kunming (CN)

( * ) Notice: Subject to any disclaimer, the term of this patent is extended or adjusted under 35 U.S.C. 154(b) by 0 days.

(21) Appl. No.: 17/432,103

(22) PCT Filed: Oct. 21, 2020

(86) PCT No.: PCT/CN2020/122511
§ 371 (c)(1),
(2) Date: Aug. 19, 2021

(87) PCT Pub. No.: WO2022/016714
PCT Pub. Date: Jan. 27, 2022

(65) Prior Publication Data

US 2022/0087325 A1 Mar. 24, 2022

(30) Foreign Application Priority Data

Jul. 20, 2020 (CN) ..... 202010699401.6

(51) Int. Cl.
*A24F 40/70* (2020.01)
*A24F 42/80* (2020.01)
(Continued)

(52) U.S. Cl.
CPC ..... *A24F 40/70* (2020.01); *A24C 5/47* (2013.01); *A24D 3/17* (2020.01); *A24F 40/42* (2020.01)

(58) Field of Classification Search
CPC ..... A24F 40/70; A24F 42/80
See application file for complete search history.

(56) References Cited

U.S. PATENT DOCUMENTS 5,190,060 A * 3/1993 Gerding ..... A24D 1/22 131/194
5,331,981 A * 7/1994 Tamaoki ..... A24F 42/60 131/335
(Continued)

FOREIGN PATENT DOCUMENTS

CN 109349683 A 2/2019
CN 109393550 A 3/2019
(Continued)

*Primary Examiner* — Cynthia Szewczyk
(74) *Attorney, Agent, or Firm* — Bayramoglu Offices LLC

(57) ABSTRACT

A method for filling an aerosol generating product includes: preparing a tube body of the aerosol generating product; filling a filter element into the tube body, wherein the filter element is adjacent to a near-lip end of the tube body; installing a blocking and flow guide element from a far-lip end of the tube body; installing a fuming unit from the far-lip end of the tube body, where the fuming unit is located at the far-lip end of the tube body; and sealing the far-lip end of the tube body, and forming a sealing part on an end face of the far-lip end of the tube body. In the new method, each component is successively filled from the near-lip end to the far-lip end of the aerosol generating product, thereby effec-
(Continued)

tively avoiding the pollution caused by the fuming unit on the tube body during the filling of the fuming unit.

6 Claims, 3 Drawing Sheets

(51) Int. Cl.

| | |
|---|---|
| ***A24C 5/47*** | (2006.01) |
| ***A24D 3/17*** | (2020.01) |
| ***A24F 40/42*** | (2020.01) |

(56) References Cited

U.S. PATENT DOCUMENTS

| | | | | |
|---|---|---|---|---|
| 9,913,492 | B1 * | 3/2018 | Horian | A61M 15/06 |
| 2008/0185011 | A1 | 8/2008 | Sherwood | |
| 2017/0340017 | A1 * | 11/2017 | Thorens | H05B 6/108 |
| 2018/0007972 | A1 * | 1/2018 | Thorens | A61M 11/003 |

FOREIGN PATENT DOCUMENTS

| | | | | |
|---|---|---|---|---|
| CN | 109512022 | A | 3/2019 | |
| CN | 110839953 | A | 2/2020 | |
| CN | 111150111 | A | 5/2020 | |
| CN | 212697652 | U | 3/2021 | |
| WO | WO-2019179532 | A1 * | 9/2019 | A24B 15/16 |
| WO | WO-2020113796 | A1 * | 6/2020 | A24B 15/16 |

* cited by examiner

METHOD FOR FILLING AEROSOL GENERATING PRODUCT AND PREPARED AEROSOL GENERATING PRODUCT

CROSS REFERENCE TO THE RELAYED APPLICATIONS

This application is the national phase entry of International Application No. PCT/CN2020/122511, filed on Oct. 21, 2020, which is based upon and claims priority to Chinese Patent Application No. 202010699401.6, filed on Jul. 20, 2020, the entire contents of which are incorporated herein by reference.

TECHNICAL FIELD

The present invention relates to the technical field of production of low-temperature heating non-combustion products, and more particularly, to a method for filling an aerosol generating product and a prepared aerosol generating product.

BACKGROUND

The low-temperature heating non-combustion products greatly reduce the harmful substances in smoke due to low-temperature heating non-combustion, and the reduced secondhand smoke and other advantages make it highly respected by many tobacco companies. At present, a fuming section of the low-temperature heating non-combustion product on the market is mainly formed of granular fuming materials, cut tobacco, or flake and paste fuming materials.

The patent CN110292196A discloses a cigarette cartridge production line, which includes a paper tube feeding mechanism, a paper tube paper-sticking mechanism, a fuming particle feeding mechanism, a fastener feeding mechanism, a filtering particle feeding mechanism, a pomander feeding mechanism, a cotton column feeding mechanism and a finished product feeding mechanism. The paper tube feeding mechanism arrays paper tubes and feeds the paper tubes to the paper tube paper-sticking mechanism, and the paper tube paper-sticking mechanism performs gluing, sticking and cutting on the paper tubes, so that one end of the paper tubes is sealed. After that, the paper tubes are conveyed into the fuming particle feeding mechanism, and the fuming particle feeding mechanism feeds fuming particles into the paper tubes. Then the fastener feeding mechanism pushes fasteners into the paper tubes, the filtering particle feeding mechanism feeds filtering particles into the paper tubes, the pomander feeding mechanism feeds pomanders into the paper tubes, and finally the cotton column feeding mechanism pushes cotton columns into the paper tubes, thus cigarette cartridge products can be finished. The finished cigarette cartridge products are arrayed to be fed and packaged through the finished product feeding mechanism.

The patent CN109770422A discloses a cooling composite filter rod and a manufacturing process thereof. The manufacturing process of the cooling composite filter rod includes: pushing in a fastener from a first section of a round tube to reach a certain distance, where the distance forms an accommodation chamber in the round tube; feeding cooling particles from a second end of the round tube to enable the cooling particles to contact the fastener and form a cooling layer; and pushing in a filter cotton section from the second end of the round tube to enable the filter cotton section to contact the cooling layer, thus completing the assembly of a cooling composite filter rod unit.

The patent CN109512022A discloses a preparation method of a hollow tube filling-type heating non-combustion fuming product with a sealing film and an application thereof. The preparation method is: sealing one end of a circular hollow tube at first by a sealing film that is easily torn by a needle or a slice, filling the circular hollow tube with a fuming section, and then filling the circular hollow tube with a blocking slice that is axially provided with a plurality of through holes, reserving a cavity behind the blocking slice as a supporting section, filling a filter section behind the supporting section, and sealing, thereby preparing the fuming product.

From the above, the production process sequence of the aerosol generating product in the prior art is as follows (as shown in FIG. 7): sealing one end of a tube, filling a fuming section, filling a blocking and flow guide element, and filling a filter section. That is to say, the aerosol generating product in the prior art is sealed at a far-lip end, while the fuming particles are filled from the end of the tube adjacent to a lip end. After the tube is sealed, it is necessary to install the fuming material from the near-lip end of the tube to the far-lip end of the tube. However, the moisture of fuming particles or fuming paste, the fuming agent, the fragrance raw materials, the color of particle raw materials and the like are prone to cause the pollution on the tube, which mainly leads to three problems: 1. serious waste of materials, large loss of raw materials and low qualification rate; 2. high intensity and low efficiency of manual quality inspection; and 3. affecting users' smoking experience.

In order to solve the above problems, the present invention is proposed.

SUMMARY

The first aspect of the present invention provides a method for filling an aerosol generating product, and the method includes the following steps:

step (1): preparing a tube body of the aerosol generating product;

step (2): filling a filter element into the tube body, where the filter element is adjacent to a near-lip end of the tube body;

step (3): installing a blocking and flow guide element from a far-lip end of the tube body;

step (4): installing a fuming unit from the far-lip end of the tube body, where the fuming unit is located at the far-lip end of the tube body; and step (5): sealing the far-lip end of the tube body, and forming a sealing part on an end face of the far-lip end of the tube body.

Preferably, in step (2), the filter element can be installed from the far-lip end of the tube body or from the near-lip end of the tube body as long as the filter element can be installed into the side of the tube body adjacent to the near-lip end.

Preferably, in step (2), a settlement unit is reserved between the filter element and an end face of the near-lip end of the tube body. That is to say, a certain cavity is reserved between the filter element and the end face of the near-lip end of the tube body, and the cavity is used as the settlement unit. The arrangement of the settlement unit has the following two purposes: first, the oral cavity of a user directly contacts the settlement unit instead of the filter element during smoking, so as to eliminate the user's doubt that it is unsafe for the oral cavity to directly contact the filter element; secondly, the existence of the settlement unit can also better prevent pollution to the filter element in the production process and improve the production quality.

Preferably, in step (3), a cavity is reserved between the blocking and flow guide element and the filter element, and the cavity is used as a functional unit.

Preferably, between step (2) and step (3), the method further includes the following step: installing a functional material from the far-lip end of the tube body, where the functional material located between the blocking and flow guide element and the filter element is referred to as the functional unit.

Specifically, there are three cases when the blocking and flow guide element is installed after the filter element is installed. In the first case, the blocking and flow guide element can be directly installed, and the blocking and flow guide element is directly tightly attached to the filter element. In the second case, the blocking and flow guide element can be directly installed, but a cavity is reserved between the blocking and flow guide element and the filter element, and the cavity is used as a functional area. If it is desirable to install a certain functional material in the functional area, this is the third case. In the third case, before installing the blocking and flow guide element, the functional material is installed adjacent to the filter element, and then the blocking and flow guide element is installed after the functional material is installed.

Preferably, the tube body is a tubular columnar three-dimensional structure, and the material of the tube body includes but is not limited to paper, ceramic, temperature-resistant resin, and clay. The tube body is intended to wrap the blocking and flow guide element, the fuming unit, the filter element and others, and thus requires a material with certain hardness and stiffness to ensure that it will not be deformed during processing.

The material of the filter element includes but is not limited to paper, polylactic acid, cellulose acetate fibre, cotton, and resin. The filter element is mainly configured to filter smoke, and the size of the filter element depends on the size of the tube body. The filter element can be formed of a single material, or a characteristic filter material, such as a hollow nozzle rod, a concentric circle filter tip, a groove filter tip, a color filter tip, a filter tip with pomanders, and the like. The cellulose acetate fibre refers to the commonly used cellulose acetate tow.

The center of the blocking and flow guide element is provided with a vent hole axially penetrating the blocking and flow guide element, and the material of the blocking and flow guide element includes but is not limited to temperature-resistant resin, paper, ceramic, metal, inorganic material and wood. The blocking and flow guide element is mainly configured to block the fuming unit while guiding smoke. When the functional material is arranged between the blocking and flow guide element and the filter element, the blocking and flow guide element is mainly configured to block the fuming unit and the functional material.

The temperature-resistant resin has the required minimum softening temperature of 100° C., and includes but is not limited to hydrogenated petroleum resin, polyimide, polytetrafluoroethylene, polyether-ether-ketone (PEEK) resin and the like.

The fuming unit is fuming particles or fuming paste configured to be heated to generate aerosols.

The material of the sealing part includes but is not limited to paper, aluminum foil and chemical fiber products, and the purpose of sealing is to prevent the material of the fuming unit from falling and leaking. For the specific sealing form, material and method, please refer to the patent with an application number of 201811285168.6, entitled as Sealing Means of Heating Non-combustion Products.

The second aspect of the present invention provides an aerosol generating product prepared by the method of the first aspect of the present invention, and the aerosol generating product includes a tube body, a filter element, a blocking and flow guide element, a fuming unit, and a sealing part. Specifically, the filter element, the blocking and flow guide element, and the fuming unit are successively arranged from a near-lip end to a far-lip end in the tube body, and the sealing part is located on an end face of the far-lip end of the tube body.

The third aspect of the present invention provides an aerosol generating product prepared by the method of the first aspect of the present invention, and the aerosol generating product includes a tube body, a settlement unit, a filter element, a blocking and flow guide element, a fuming unit, and a sealing part. Specifically, the settlement unit, the filter element, the blocking and flow guide element, and the fuming unit are successively arranged from a near-lip end to a far-lip end in the tube body, and the sealing part is located on an end face of the far-lip end of the tube body.

The fourth aspect of the present invention provides an aerosol generating product prepared by the method of the first aspect of the present invention, and the aerosol generating product includes a tube body, a filter element, a functional unit, a blocking and flow guide element, a fuming unit, and a sealing part. Specifically, the filter element, the functional unit, the blocking and flow guide element, and the fuming unit are successively arranged from a near-lip end to a far-lip end in the tube body, and the sealing part is located on an end face of the far-lip end of the tube body. The functional unit is a cavity.

The fifth aspect of the present invention provides an aerosol generating product prepared by the method of the first aspect of the present invention, and the aerosol generating product includes a tube body, a filter element, a functional unit, a blocking and flow guide element, a fuming unit, and a sealing part. Specifically, the filter element, the functional unit, the blocking and flow guide element, and the fuming unit are successively arranged from a near-lip end to a far-lip end in the tube body, and the sealing part is located on an end face of the far-lip end of the tube body. The functional unit is a functional material. The functional material is selected from pomanders, cooling materials and slowly releasing fragrance materials.

That is to say, the functional unit is a personalized and multi-style customization module, which can be a cavity described in the fourth aspect or a functional unit with the functional material in the cavity described in the fifth aspect.

Compared with the prior art, the present invention has the following advantages.

1. The present invention innovatively proposes that each component is successively filled from the near-lip end to the far-lip end of the aerosol generating product, that is, during the filling of the aerosol generating product of the present invention, the fuming unit is finally filled, and the end face of the far-lip end is sealed, thereby effectively avoiding the pollution on the tube body caused by the moisture of fuming particles or fuming paste, the fuming agent, the fragrance raw materials, the color of particle raw materials and the like during the filling of the fuming unit.

2. The method for filling the aerosol generating product according to the present invention has a high qualification rate, which effectively solves the pollution caused by fuming particles on cartridges in the prior art. The qualification rate of product appearance can reach 100%, thereby reducing the manual quality inspection intensity, improving quality inspection efficiency, reducing loss, saving cost, and increasing profit space for enterprises. On the other hand, the qualification rate is improved, so that the production capacity is obviously improved, the production efficiency is greatly improved, and the utilization of resources is maximized.

3. The aerosol generating product of the present invention satisfies the differentiated product customization in the market. In view of the serious homogenization of the existing products in the market, the present invention realizes the personalized and functional customization of the products by adding functional materials.

In the figures: 1—tube body, 2—filter element, 3—blocking and flow guide element, 4—fuming unit, 5—sealing part, 6—settlement unit, 7—functional unit, 31—vent hole.

DETAILED DESCRIPTION OF THE EMBODIMENTS

The present invention is further described in detail below in conjunction with the embodiments and the drawings, and the embodiments are only used to illustrate the present invention and not limit the present invention.

Embodiment 1

This embodiment is a preparation of the aerosol generating product sample 1.

Figure 1:
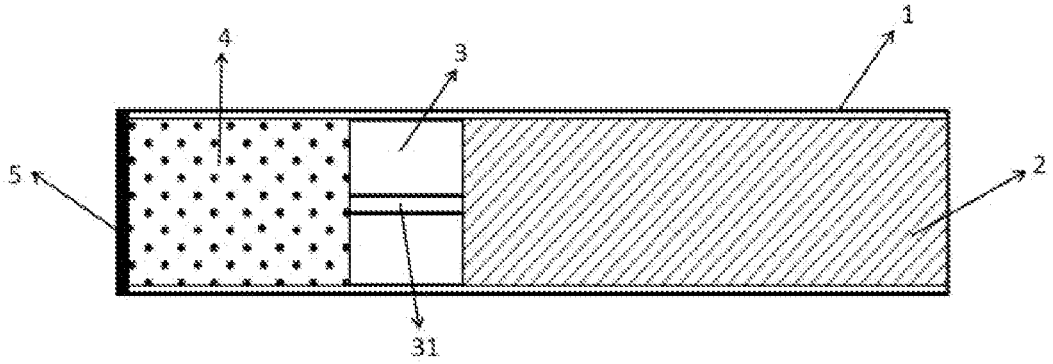
FIG. 1 is a schematic diagram of the structure of an aerosol generating product sample 1 according to Embodiment 1 of the present invention.

As shown in FIG. 1, the aerosol generating product sample 1 includes the tube body 1, the filter element 2, the blocking and flow guide element 3, the fuming unit 4, and the sealing part 5. The filter element 2, the blocking and flow guide element 3, and the fuming unit 4 are successively arranged from a near-lip end to a far-lip end in the tube body 1, and the sealing part 5 is located on an end face of the far-lip end of the tube body 1.

Figure 8:
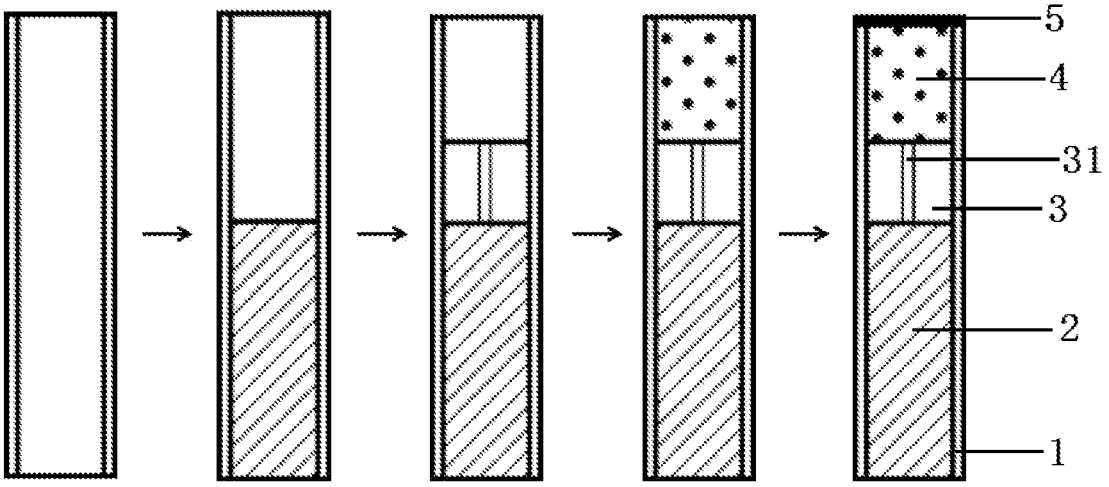
FIG. 8 is a production process of an aerosol generating product in the present invention.

A method for filling the aerosol generating product sample 1 includes the following steps (FIG. 8): (1) preparing the tube body 1 of the aerosol generating product; (2) filling the filter element 2 into the tube body 1, where the filter element 2 is adjacent to an end face of the near-lip end of the tube body 1; (3) installing the blocking and flow guide element 3 from the far-lip end of the tube body 1, where the blocking and flow guide element 3 is tightly attached to the filter element 2; (4) installing the fuming unit 4 from the far-lip end of the tube body 1, where the fuming unit 4 is located at the far-lip end of the tube body 1; and (5) sealing the far-lip end of the tube body 1, and forming the sealing part 5 on the end face of the far-lip end of the tube body 1.

The tube body 1 is a tubular columnar three-dimensional structure, and the material of the tube body 1 is selected from paper. The material of the filter element 2 is selected from polylactic acid. The center of the blocking and flow guide element 3 is provided with the vent hole 31 axially penetrating the blocking and flow guide element 3, and the material of the blocking and flow guide element 3 is selected from nickel. The fuming unit 4 is fuming particles configured to be heated to generate aerosols. The material of the sealing part 5 is selected from paper.

Embodiment 2

This embodiment is a preparation of the aerosol generating product sample 2.

Figure 2:
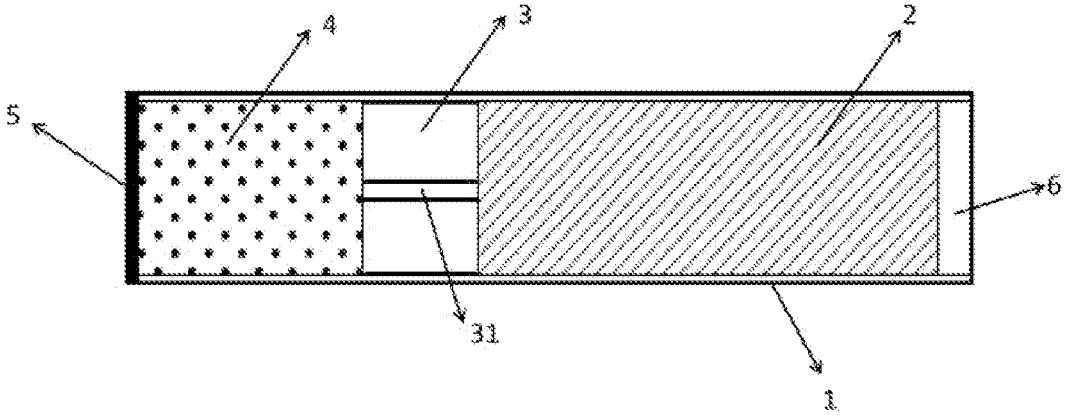
FIG. 2 is a schematic diagram of the structure of an aerosol generating product sample 2 according to Embodiment 2 of the present invention.

As shown in FIG. 2, the aerosol generating product sample 2 includes the tube body 1, the settlement unit 6, the filter element 2, the blocking and flow guide element 3, the fuming unit 4, and the sealing part 5. The settlement unit 6, the filter element 2, the blocking and flow guide element 3, and the fuming unit 4 are successively arranged from a near-lip end to a far-lip end in the tube body 1, and the sealing part 5 is located on an end face of the far-lip end of the tube body 1.

A method for filling the aerosol generating product sample 2 includes the following steps: (1) preparing the tube body 1 of the aerosol generating product; (2) filling the filter element 2 into the tube body 1, where the filter element 2 is adjacent to the near-lip end of the tube body 1, a certain cavity is reserved between the filter element 2 and an end face of the near-lip end of the tube body 1, and the cavity is used as the settlement unit 6; (3) installing the blocking and flow guide element 3 from the far-lip end of the tube body 1, where the blocking and flow guide element 3 is tightly attached to the filter element 2; (4) installing the fuming unit 4 from the far-lip end of the tube body 1, where the fuming unit 4 is located at the far-lip end of the tube body 1; and (5) sealing the far-lip end of the tube body 1, and forming the sealing part 5 on the end face of the far-lip end of the tube body 1.

The tube body 1 is a tubular columnar three-dimensional structure, and the material of the tube body 1 is selected from clay. The material of the filter element 2 is selected from cotton. The center of the blocking and flow guide element 3 is provided with the vent hole 31 axially penetrating the blocking and flow guide element 3, and the material of the blocking and flow guide element 3 is selected from polyether-ether-ketone (PEEK) resin. The fuming unit 4 is fuming particles configured to be heated to generate aerosols. The material of the sealing part 5 is selected from paper.

Embodiment 3

This embodiment is a preparation of the aerosol generating product sample 3.

Figure 3:
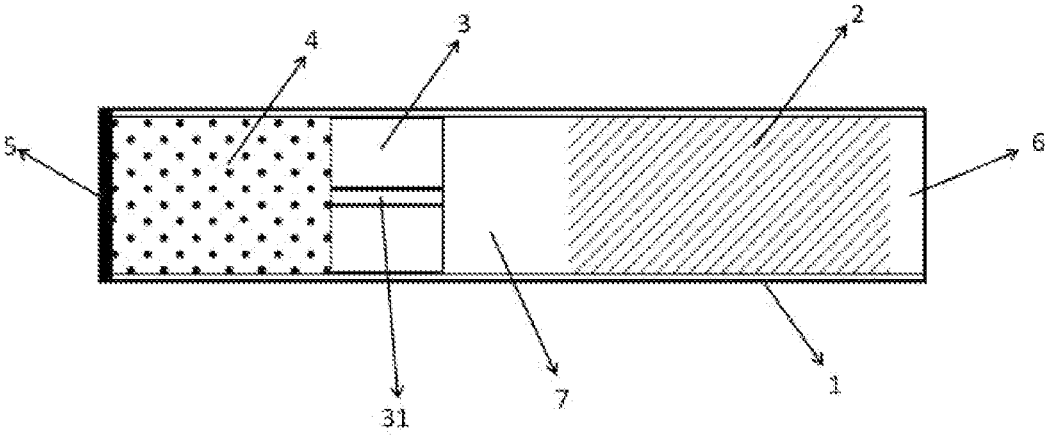
FIG. 3 is a schematic diagram of the structure of an aerosol generating product sample 3 according to Embodiment 3 of the present invention.

As shown in FIG. 3, the aerosol generating product sample 3 includes the tube body 1, the settlement unit 6, the filter element 2, the functional unit 7 in the form of cavity, the blocking and flow guide element 3, the fuming unit 4, and the sealing part 5. The settlement unit 6, the filter element 2, the functional unit 7 in the form of cavity, the blocking and flow guide element 3, and the fuming unit 4 are successively arranged from a near-lip end to a far-lip end in the tube body 1, and the sealing part 5 is located on an end face of the far-lip end of the tube body 1.

A method for filling the aerosol generating product sample 3 includes the following steps: (1) preparing the tube body 1 of the aerosol generating product; (2) filling the filter element 2 into the tube body 1, where the filter element 2 is adjacent to the near-lip end of the tube body 1, a certain cavity is reserved between the filter element 2 and an end face of the near-lip end of the tube body 1, and the cavity is used as the settlement unit 6; (3) installing the blocking and flow guide element 3 from the far-lip end of the tube body 1, where a cavity is reserved between the blocking and flow guide element 3 and the filter element 2, and the cavity is used as a functional area, also referred to as the functional unit 7; (4) installing the fuming unit 4 from the far-lip end of the tube body 1, where the fuming unit 4 is located at the far-lip end of the tube body 1; and (5) sealing the far-lip end of the tube body 1, and forming the sealing part 5 on the end face of the far-lip end of the tube body 1.

The tube body 1 is a tubular columnar three-dimensional structure, and the material of the tube body 1 is selected from ceramic. The material of the filter element 2 is selected from cellulose acetate fibre. The center of the blocking and flow guide element 3 is provided with the vent hole 31 axially penetrating the blocking and flow guide element 3, and the material of the blocking and flow guide element 3 is selected from wood. The fuming unit 4 is fuming paste configured to be heated to generate aerosols. The material of the sealing part 5 is selected from aluminum foil.

Embodiment 4

This embodiment is a preparation of the aerosol generating product sample 4.

Figure 4:
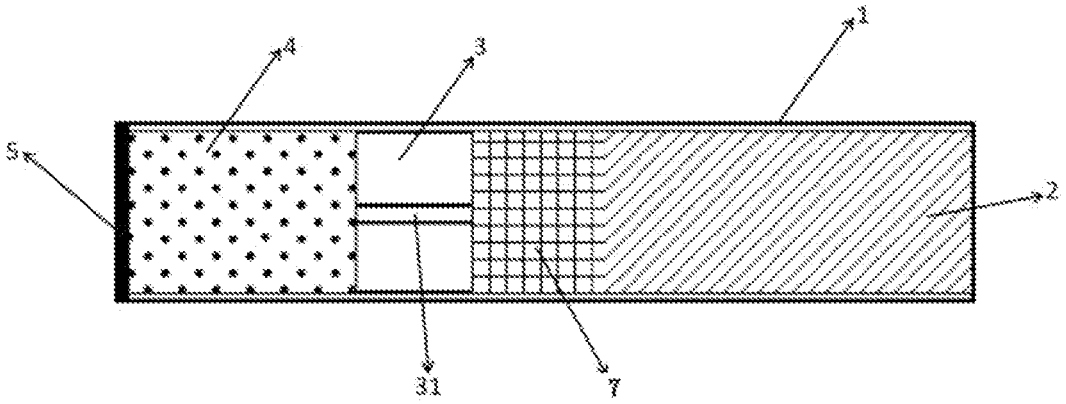
FIG. 4 is a schematic diagram of the structure of an aerosol generating product sample 4 according to Embodiment 4 of the present invention.

As shown in FIG. 4, the aerosol generating product sample 4 includes the tube body 1, the filter element 2, the functional unit 7, the blocking and flow guide element 3, the fuming unit 4, and the sealing part 5. The filter element 2, the functional unit 7, the blocking and flow guide element 3, and the fuming unit 4 are successively arranged from a near-lip end to a far-lip end in the tube body 1, and the sealing part 5 is located on an end face of the far-lip end of the tube body 1.

A method for filling the aerosol generating product sample 4 includes the following steps: (1) preparing the tube body 1 of the aerosol generating product; (2) filling the filter element 2 into the tube body 1, where the filter element 2 is adjacent to an end face of the near-lip end of the tube body 1; (3) installing a functional material from the far-lip end of the tube body 1, where the functional material (a cooling material) located between the blocking and flow guide element 3 and the filter element 2 is referred to as the functional unit 7; (4) installing the blocking and flow guide element 3 from the far-lip end of the tube body 1; (5) installing the fuming unit 4 from the far-lip end of the tube body 1, where the fuming unit 4 is located at the far-lip end of the tube body 1; and (6) sealing the far-lip end of the tube body 1, and forming the sealing part 5 on the end face of the far-lip end of the tube body 1.

The tube body 1 is a tubular columnar three-dimensional structure, and the material of the tube body 1 is selected from hydrogenated petroleum resin. The material of the filter element 2 is selected from paper. The center of the blocking and flow guide element 3 is provided with the vent hole 31 axially penetrating the blocking and flow guide element 3, and the material of the blocking and flow guide element 3 is selected from diatomite. The fuming unit 4 is fuming paste configured to be heated to generate aerosols. The material of the sealing part 5 is selected from nylon.

Embodiment 5

This embodiment is a preparation of the aerosol generating product sample 5.

Figure 5:
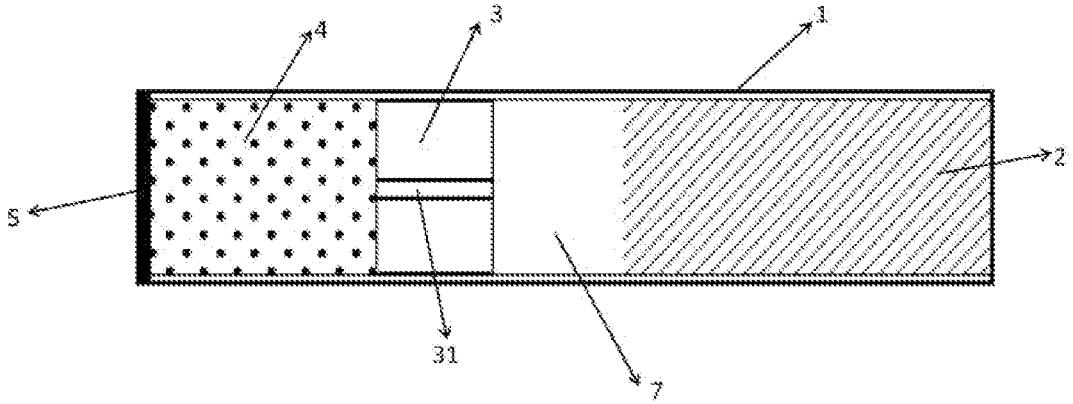
FIG. 5 is a schematic diagram of the structure of an aerosol generating product sample 5 according to Embodiment 5 of the present invention.

As shown in FIG. 5, the aerosol generating product sample 5 includes the tube body 1, the filter element 2, the functional unit 7 in a form of cavity, the blocking and flow guide element 3, the fuming unit 4, and the sealing part 5. The filter element 2, the functional unit 7 in a form of cavity, the blocking and flow guide element 3, and the fuming unit 4 are successively arranged from a near-lip end to a far-lip end in the tube body 1, and the sealing part 5 is located on an end face of the far-lip end of the tube body 1.

A method for filling the aerosol generating product sample 5 includes the following steps: (1) preparing the tube body 1 of the aerosol generating product; (2) filling the filter element 2 into the tube body 1, where the filter element 2 is adjacent to an end face of the near-lip end of the tube body 1; (3) installing the blocking and flow guide element 3 from the far-lip end of the tube body 1, where a cavity is reserved between the blocking and flow guide element 3 and the filter element 2, and the cavity is used as a functional area, also referred to as the functional unit 7; (4) installing the fuming unit 4 from the far-lip end of the tube body 1, where the fuming unit 4 is located at the far-lip end of the tube body 1; and (5) sealing the far-lip end of the tube body 1, and forming the sealing part 5 on the end face of the far-lip end of the tube body 1.

The tube body 1 is a tubular columnar three-dimensional structure, and the material of the tube body 1 is selected from ceramic. The material of the filter element 2 is selected from cellulose acetate fibre. The center of the blocking and flow guide element 3 is provided with the vent hole 31 axially penetrating the blocking and flow guide element 3, and the material of the blocking and flow guide element 3 is selected from wood. The fuming unit 4 is fuming paste configured to be heated to generate aerosols. The material of the sealing part 5 is selected from aluminum foil.

Embodiment 6

This embodiment is a preparation of the aerosol generating product sample 6.

Figure 6:
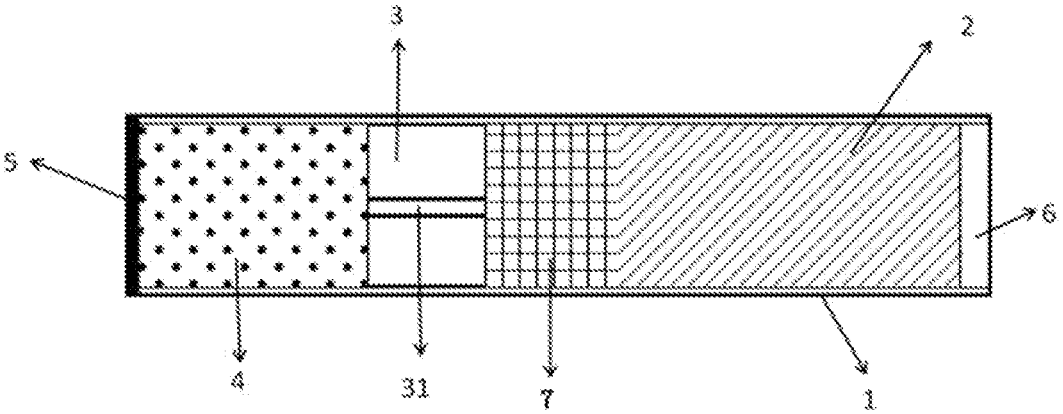
FIG. 6 is a schematic diagram of the structure of an aerosol generating product sample 6 according to Embodiment 6 of the present invention.
Figure 7:
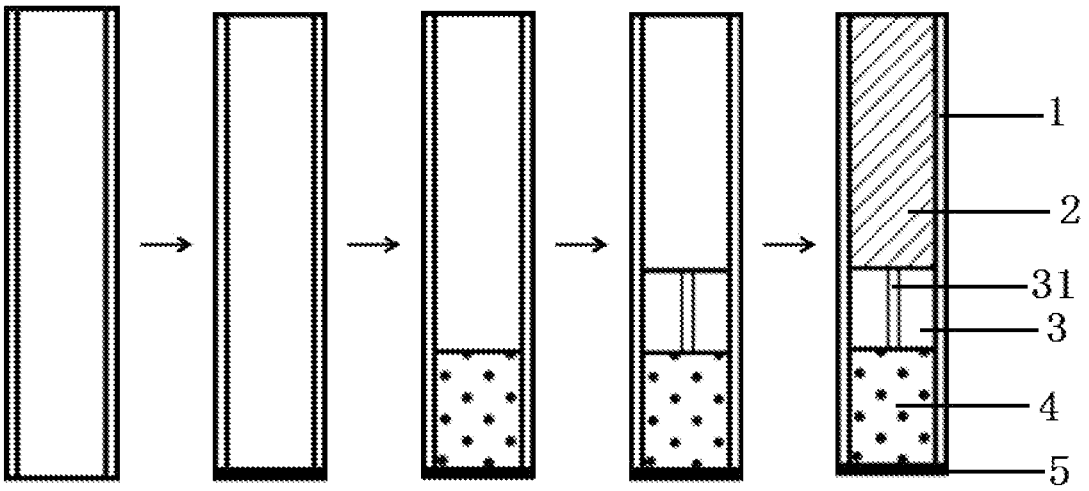
FIG. 7 (Prior art)
FIG. 7 is a production process of an aerosol generating product in the prior art.

As shown in FIG. 6, the aerosol generating product sample 6 includes the tube body 1, the settlement unit 6, the filter element 2, the functional unit 7, the blocking and flow guide element 3, the fuming unit 4, and the sealing part 5. The settlement unit 6, the filter element 2, the functional unit 7, the blocking and flow guide element 3, and the fuming unit 4 are successively arranged from a near-lip end to a far-lip end in the tube body 1, and the sealing part 5 is located on an end face of the far-lip end of the tube body 1.

A method for filling the aerosol generating product sample 6 includes the following steps: (1) preparing the tube body 1 of the aerosol generating product; (2) filling the filter element 2 into the tube body 1, where the filter element 2 is adjacent to the near-lip end of the tube body 1, a certain cavity is reserved between the filter element 2 and an end face of the near-lip end of the tube body 1, and the cavity is used as the settlement unit 6; (3) installing a functional material from the far-lip end of the tube body 1, where the functional material (a cooling material) located between the blocking and flow guide element 3 and the filter element 2 is referred to as the functional unit 7; (4) installing the blocking and flow guide element 3 from the far-lip end of the tube body 1; (5) installing the fuming unit 4 from the far-lip end of the tube body 1, where the fuming unit 4 is located at the far-lip end of the tube body 1; and (6) sealing the far-lip end of the tube body 1, and forming the sealing part 5 on the end face of the far-lip end of the tube body 1.

The tube body 1 is a tubular columnar three-dimensional structure, and the material of the tube body 1 is selected from hydrogenated petroleum resin. The material of the filter element 2 is selected from paper. The center of the blocking and flow guide element 3 is provided with the vent hole 31 axially penetrating the blocking and flow guide element 3, and the material of the blocking and flow guide element 3 is selected from diatomite. The fuming unit 4 is fuming paste configured to be heated to generate aerosols. The material of the sealing part 5 is selected from nylon.

What is claimed is:

1. A method for filling an aerosol generating product, comprising the following steps:

step (1): preparing a tube body of the aerosol generating product;

step (2): filling a filter element into the tube body, wherein the filter element is adjacent to a near-lip end of the tube body;

step (3): installing a blocking and flow guide element from a far-lip end of the tube body;

step (4): installing a fuming unit from the far-lip end of the tube body, wherein the fuming unit is located at the far-lip end of the tube body; and step (5): sealing the far-lip end of the tube body, and forming a sealing part on an end face of the far-lip end of the tube body.

2. The method of claim 1, wherein in step (2), the filter element is installed from the far-lip end of the tube body or from the near-lip end of the tube body.

3. The method of claim 1, wherein in step (2), a settlement unit is reserved between the filter element and an end face of the near-lip end of the tube body.

4. The method of claim 1, wherein in step (3), a cavity is reserved between the blocking and flow guide element and the filter element, and the cavity is used as a functional unit.

5. The method of claim 1, wherein between step (2) and step (3), the method further comprises the following step: installing a functional material from the far-lip end of the tube body, wherein the functional material located between the blocking and flow guide element and the filter element is referred to as a functional unit.

6. The method of claim 1, wherein the tube body is a tubular columnar three-dimensional structure, and a material of the tube body is selected from the group consisting of paper, ceramic, resin and clay;

a material of the filter element is selected from the group consisting of paper, polylactic acid, cellulose acetate fibre, cotton and resin;

a center of the blocking and flow guide element is provided with a vent hole (31) axially penetrating the blocking and flow guide element, and a material of the blocking and flow guide element is selected from the group consisting of resin, paper, ceramic, metal, inorganic material and wood;

the fuming unit is fuming particles or fuming paste configured to be heated to generate aerosols; and a material of the sealing part is selected from the group consisting of paper, aluminum foil, and chemical fiber.

* * * * *